United States Patent [19]

Ludwig

[11] 4,004,675

[45] Jan. 25, 1977

[54] TABULATOR DEVICE FOR TYPEWRITERS AND THE LIKE

[75] Inventor: Martin Ludwig, Munich, Germany

[73] Assignee: Siemens Aktiengesellschaft, Berlin & Munich, Germany

[22] Filed: Jan. 23, 1975

[21] Appl. No.: 543,526

[30] Foreign Application Priority Data

Jan. 25, 1974 Germany ..... 2403653

[52] U.S. Cl. ..... 197/176

[51] Int. Cl.[2] ..... B41J 25/18

[58] Field of Search ..... 35/5, 6; 197/19, 20, 197/176, 177, 178, 179; 235/61.9 R; 340/173 R, 172.5

[56] References Cited

UNITED STATES PATENTS

| | | | |
|---|---|---|---|
| 3,749,223 | 7/1973 | Guzak | 197/176 |
| 3,824,564 | 7/1974 | Wegener | 340/173 R |
| 3,829,855 | 8/1974 | Kolpek et al. | 197/176 X |
| 3,832,697 | 8/1974 | Kashio | 197/176 X |
| 3,885,663 | 5/1975 | Suzuki | 197/176 |

OTHER PUBLICATIONS

IBM Technical Disclosure Bulletin, "Electronic Tab/-Backspace Control," Fulbright et al., vol. 13, No. 10, Mar. 1971, pp. 3182–3184.

*Primary Examiner*—Paul E. Shapiro
*Assistant Examiner*—Vance Y. Hum
*Attorney, Agent, or Firm*—Hill, Gross, Simpson, Van Santen, Steadman, Chiara & Simpson

[57] ABSTRACT

A tabulator device for typewriters, particularly for teleprinters or data-printers in which tabulation marks are set, cancelled and recalled, in which a store having electronically operable storage elements are operative to effect storage of the desired tabulation marks, register means being provided for addressing the respective storage elements of such store, with the setting i.e. insertion, or cancelling i.e. removal of a mark from the store being effected by means of a write-in control unit operatively connected thereto and tabulation marks being read out of the store by the aid of a read-out control unit operatively connected thereto. The store is in the form of a semi-conductor store constructed from MNOS (metal-nitride-oxide-substrate) transistors and thus does not change its contents following disconnection of the operating voltage. Where the matrix is in the form of a row and column matrix, two registers may be employed which may be in the form of shift registers provided with feedback.

2 Claims, 3 Drawing Figures

TABULATOR DEVICE FOR TYPEWRITERS AND THE LIKE

BACKGROUND OF THE INVENTION

The invention is directed to a tabulator device for typewriters, particularly for teleprinters or data-printers, in which tabulation marks are set, cancelled and recalled.

Tabulator devices are provided as an additional feature on typewriters and the like as an assistance to the typist, and are employed, for example, on teleprinters. In the event tabulation is involved, the tabulation marks are set at the desired points along a line subsequent to the beginning of a sheet or form which is to receive the typing. During the typing on such sheet or form, the carriage of the machine is automatically moved to the next tabulation mark in response to the depression of a tabulation key. Likewise, where vertical tabulation is involved, the tabulation marks are set at given lines following the beginning of the form and the line feed is actuated, following each depression of the tabulator key, until the next tabulator mark is reached.

Tabulator devices have been employed for many years in connection with typewriters and the like, in the form of stops or riders which are displaceable with respect to a bar, or other member, from an inoperable position to a tabulating position,. The riders are scanned by suitable scanning elements controlling the horizontal movement of the typewriter carriage, for example, in response to the signal "interspace" and the vertical movement in response to the signal "line feed".

Known tabulator devices have the disadvantages that they contain moving mechanical parts and the means for adjusting the riders is relatively complicated and thus requires a relatively large cost outlay.

BRIEF SUMMARY OF THE INVENTION

The invention therefore has the objective of providing a tabulator device which does not contain any moving mechanical components, and is relatively inexpensive, thereby eliminating the above referred to disadvantages.

The desired results are achieved in the present invention by the utilization of a tabulator device including a store, constructed from electronically operable storage elements, in which the tabulation marks are stored, in conjunction with register means which contains the addresses of the particular actuated storage elements, by utilization of a write-in control unit, operable to effect either entry or cancellation of the tabulation marks in the store, with such marks being read out therefrom by means of a read-out control unit.

A tabulation device in accordance with the present invention has the advantage that little servicing is required, as it does not contain any moving mechanical parts subject to wear, and requires only a relatively low cost outlay. In addition, it has the advantage that simultaneous tabulation may be effected in the case of a remote subscriber without requiring additional procedures for effecting such results. Likewise, the store employed therewith requires an especially low cost outlay and may be of small volume in the form of a semiconductor store.

To insure that the tabulation marks are retained and not lost, following disconnection of the operating voltage of the teleprinter, advantageously the semiconductor store is constructed from MNOS (metal-nitride-oxide-substrate) transistors whereby the store will not change its contents following disconnection of the operating voltage.

The cost outlay of the store may be further reduced if it is constructed in the form of a matrix composed of a plurality of rows and columns.

As the tabulation marks are always written into or read out from the store in the same sequence, the storage elements can be operated in a particularly simple manner if the register means is in the form of shift registers, which feature feedback, and are so connected to one another that the contents of the register indicating the column of the matrix is shifted by one position following each cycle of the register indicating the row of the matrix.

BRIEF DESCRIPTION OF THE DRAWINGS

In the drawings wherein like reference characters indicate like or corresponding parts.

DETAILS OF THE INVENTION

Figure 1:
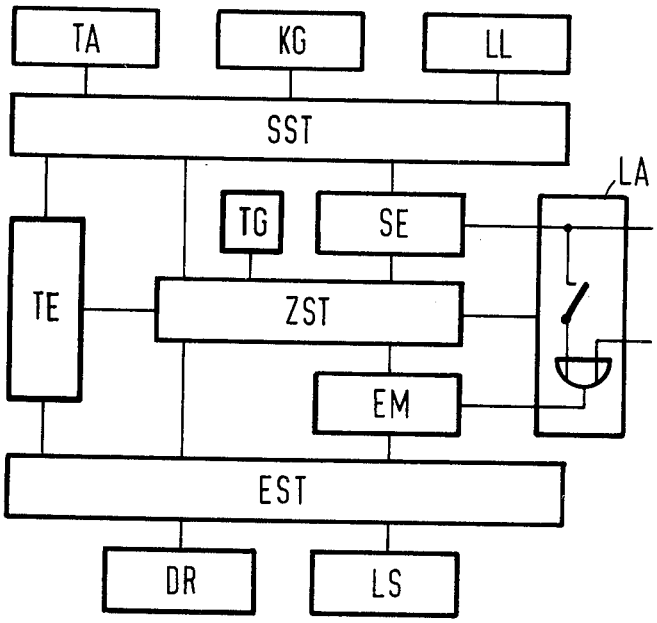
FIG. 1 is a block circuit diagram of a teleprinter employing the invention.

Referring to FIG. 1, the teleprinter circuit illustrated therein includes a tabulator device TE, along with a plurality of transmitting-end and receiving-end units, a central portion for the control of the teleprinter, and a line matching unit LA which is connected between the teleprinter and a remote switching device, not illustrated.

The transmitting-end units include a keyboard TA, a code generator KG, and a punched-tape read-out device LL, which are controlled by a transmitter control unit SST. Similarly the receiving-end units comprise a printer DR and a tape punching device LS, which are controlled by a receiver control unit EST.

The central portion of the teleprinter includes a transmitter SE, a receiver EM, a central control unit ZST, to which is connected a pulse generator TG, and the tabulator device TE. The transmitter SE includes a parallel-serial converter which converts the parallel-coded data from the transmitting-end units into serial-coded data conducted, over the line matching unit LA and the remote switching device, to a typewriter line. The receiver EM is supplied, over the first input of an OR gate in the line matching unit LA, from the teleprinter line with serial-coded data which is conducted to a serial-parallel converter, contained in the receiver EM, which converts the serial-coded data into parallel-coded data and supplies the same, over the receiver control unit EST, to the printer DR and optionally, if desired, to the tape punching device LS.

The central control unit ZST is conncted to the transmitter control unit SST, the receiver control unit EST, the transmitter SE, the receiver EM, tabulator device TE and the line matching unit LA, and controls the time sequence of the functions in the teleprinter. The line matching unit LA contains a switch, over which the transmitted signals may be conducted, for example for semi-duplex operation, from the transmitter SE over a second input of the OR gate to the receiver EM. The signals are conducted over the control unit ZST to the printer DR for the printing out of all transmitted signals as a check-out.

The tabulator device TE is connected to the transmitter control unit SST, the receiver control unit EST and to the central control unit ZST. Where a tabulation of text material is involved, employing a tabulator device, at predetermined points of a line or after a given number of lines following a mark, indicating the commencement of the form, a setting key or an erasing key is depressed to set a desired tabulation mark or to erase an existing tabulation mark. Upon resumption of the print-out of the text, the form on which the text is to be printed is moved to a point, as determined by the next tabulation mark, following each depression of the tabulator key.

Figure 2:
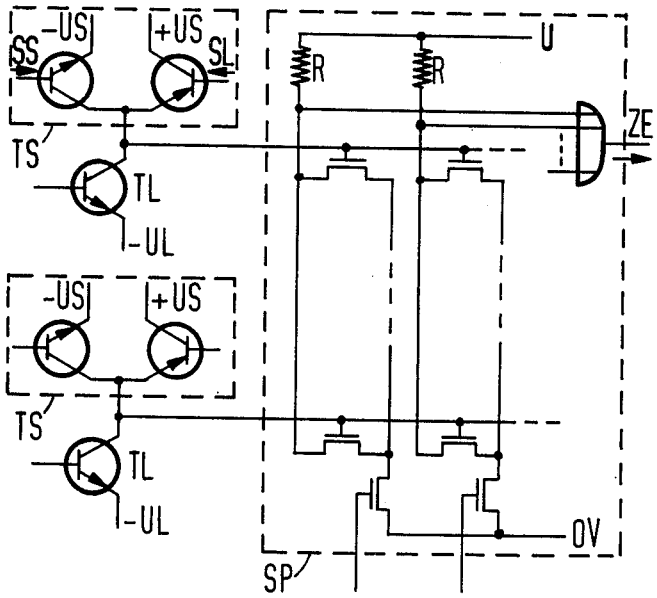
FIG. 2 is a partial schematic circuit diagram of a semiconductor store constructed with MNOS transistors.

FIG. 2 illustrates a store SP, suitable for use in the tabulation device TE which is operative to store the tabulation marks, cooperable transistors TS which are operative to effect write in of the tabulation marks, and cooperable transistors TL operative to effect a read-out of the tabulation marks. The store SP illustrated is a semiconductor store constructed from MNOS (metal-nitride-oxide-substrate) transistors for the storage of binary values. As a result of the use of MNOS transistors, the store, in contrast to conventional semiconductor stores, will retain its stored binary values even after disconnection of the operating voltages thereto. Such type of store is, for example, described in the publication "Electronic-Industrie" 5/6/1972, pages 94 and 95.

The MNOS transistors preferably are arranged in the form of a matrix comprising a plurality of rows and columns. The gate insulators of the MNOS transistors consist of a double layer which is composed of an oxide and a nitride layer. So-called traps are located at the boundary between these two layers which can be recharged by a voltage pulse across the gate electrode. The start voltage of the MNOS transistor is thus displaced. A voltage pulse of opposite polarity cancels out the shift of the start voltage and thus the binary values 0 and 1 may be assigned to the two start voltage.

The gate terminals of the MNOS transistors of a row are connected to one another, and in like manner, the source and drain terminals of a column are connected to one another, only two rows and two columns, with four storage elements, of such store being illustrated in FIG. 2. Prior to the writing in of the binary values, the store is erased by the writing in of the binary value 0, and for this purpose a positive pulse is applied to each line connected to the gates, over those of the transistors TS to which a positive voltage +US is applied. At the same time the source lines are connected over further MNOS transistors to a reference potential, and the drain lines are connected over resistors R to an operating voltage U.

Following erasure of the store SP, the individual storage elements are successively actuated in accordance with the desired tabulation. The MNOS transistors located between the source lines and the reference potential determine in which column a binary value is to be entered and the transistors TS indicate in which row such entry is to be made. A binary value 0 or 1 is written into the particular operated storage element in dependence upon whether a transistor TS is conductive to which positive voltage +US or negative voltage −US is applied.

In effecting a read-out of the binary values from the store SP, the individual storage elements are read out consecutively, the column to be read out being established by means of the source lines and the row to be read out being established by means of one of the transistors TL. A negative voltage −UL is connected to the gate lines, in each case over one of the transistors TL, with a binary signal assigned to the binary value of the storage element so selected being read out from the source line connected with the involved storage element. The binary signal is conducted over an OR gate at an output of the store SP as a signal TM, which corresponds to a tabulation mark.

Figure 3:
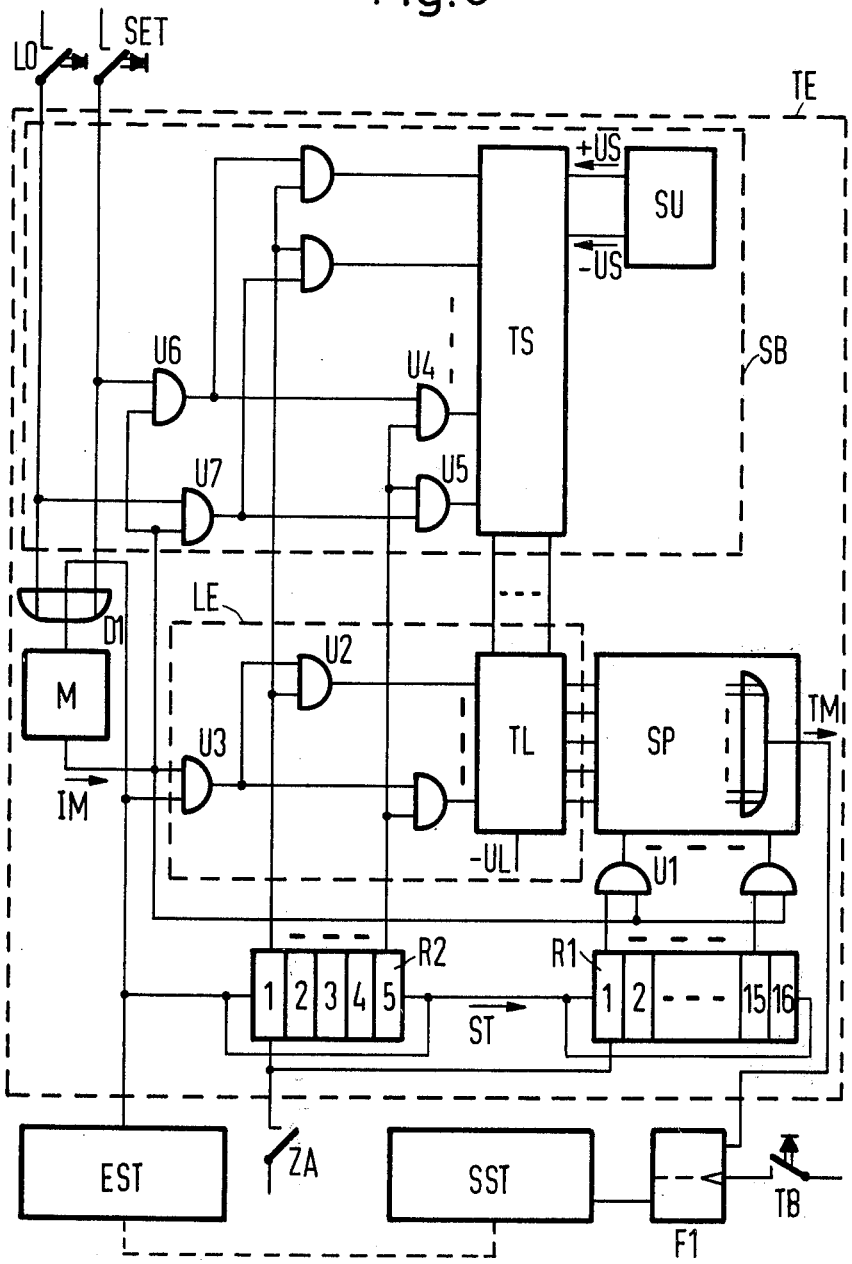
FIG. 3 is a schematic circuit diagram, in block form, of the tabulator device illustrated in FIG. 1.

FIG. 3 illustrates an exemplary embodiment of a tabular device TE, in connection with horizontal tabulation. Such device contains the store SP, two registers R1 and R2, constructed as shift registers utilizing feedback, a write-in control unit SB and a read-out control unit LE. The store is designed to store a maximum of 80 tabulation marks, respectively assigned to the individual printing points or stations of one line of a teleprinter. In the embodiment illustrated, the 80 storage elements are arranged in 16 columns and five rows. However, a shift register could be employed incorporating a single row of 80 places or columns.

Read-out is effected simultaneously with the movement of the teleprinter carriage, whereby the tabulation marks are simultaneously read out by scanning the individual columns in conjunction with the register R1 and the individual rows of the store SP being consecutively determined in conjunction with the register R2. Each position in the registers R1 and R2 has a binary value 1 or binary value 0 with the binary value 1 being utilized to designate an actuated storage position. Consequently, if the binary value 1 appears at the output of the store it signifies that a tabulation mark has been set at such point, and the teleprinter carriage is stopped.

Write-in of the tabulation marks into the store SP is effected in the same general manner as that of read-out, by means of the registers R1 and R2. At the same time, in dependence upon whether a tabulation mark is to be set or cancelled, positive or negative voltage pulses are connected to the corresponding rows of the store over transistors TS which are disposed in the write-in control unit SB, illustrated in FIG. 3.

If the store is employed for vertical tabulation, it would contain as many storage elements as there are rows involved in the tabulation with the individual storage elements being operated in the same way as with horizontal tabulation. The start of the form corresponds to the start of the row and the form-commence contact corresponds to the row-commence contact. For the sake of simplicity, the operation will be explained in connection with horizontal tabulation.

It will be initially assumed that desired tabulation marks are already stored in the store SP and a text is to be tabulated. At the start of the line, a line-commence contact ZA is closed which brings the registers R1 and R2 into their basic positions. In such basic positions, the first positions of each register R1 and R2 will assume a binary value 1 while all other positions assume a binary value 0. The binary value 1 in the register R1 releases an AND gate U1 assigned to the first column of the store SP while the binary value 1 in the register R2 releases an AND gate U2 assigned to the first row of the store SP.

Upon depression of a tabulator key TB, a flip-flop F1 is set and the transmitter control unit SST is supplied with a signal which causes the transmission of the signal "interspace". Such signal is conducted to a remote subscriber over the line and also to the receiver control unit EST over the line matching unit LA.

As a tabulation mark is not effective at the start of a line, in the embodiment illustrated the storage element assigned to the first row and the first column is not read out. Consequently, the signal TM at the output of the store SP retains the binary value 0 and flip-flop F1 is not reset.

With the first signal "interspace" emitted from the transmitter control unit SST, the receiver control unit EST produces a feed signal which is conducted to the register R2 and causes the binary value 1 to be displaced by one position. Simultaneously, the teleprinter carriage is moved by one position. The register R2 releases a non-illustrated AND-gate which is assigned to the second row of the store SP. The feed signal also releases an AND gate U3 and, the monoflop M is triggered into its astable state over an OR gate D1. An output pulse IM appears at the output of the monoflop M, the duration of which is equal to the time in which the monoflop is in its astable state. The pulse IM is conducted over the AND gate U3 and such non-illustrated AND gate to the transistors TL. The pulse IM renders a transistor TL, assigned to the second row, temporarily conductive. At the same time it is conducted over the AND gate U1 to a transistor assigned to the first column, and consequently the storage element assigned to the first column, second row, is read-out.

If the storage element contains a binary 1 and thus a tabulation mark, the signal TM at the output of the store SP assumes the binary value 1 and the flip-flop F1 is reset. The transmitter control unit SST thus does not emit another signal "interspace" and the carriage of the teleprinter remains at a position provided for the print-out of a signal. After the renewed depression of the key TB, the flip-flop F1 is again set and the transmitter control unit again supplies "interspace" signals until a tabulation mark is again read-out from the store SP.

If the binary value 1 in the register R2 has reached the fifth position and a further feed signals emitted from the receiver control unit EST, the first position of the register R2 reassumes the binary value 1. At the same time the register R1 is supplied with a signal ST which moves the binary value 1 from the first position into the second position of the register R1. Consequently, an AND gate, assigned to the second column, is released and preparation is made for the read-out of the second column. The transistor TL are again consecutively operated over the AND gates associated to the rows, and the storage elements of the second column are read out. When all such storage elements have been read out and the line feed signal is produced, as a result of the closure of line commence contact ZA, the store is brought back into its basic position and then again read out.

It will thus be appreciated that the binary value 1 is always moved in the registers R1 and R2 simultaneously with the teleprinter carriage.

The binary values 1 in the registers R1 and R2 thus indicate, through the release of AND gates, the column and row of the store SP in which a tabulator mark is to be set or cancelled.

If, for example, after four rows of "interspace" signals, a tabulation mark is to be set, the register R1 and the AND gate U1, assigned to the first column, and the register R2 release two AND gates U4 and U5 which are assigned to the fifth row of the store. In order to set a tabulation mark a setting key SET is actuated whereby a signal is emitted which is conducted, on the one hand to an AND gate U6, and, on the other hand over OR gate D1 to the monoflop M. The monoflop simultaneously supplies a pulse to the AND gate U1 and, over AND gates U6 and U4, to that of the transistors TS which is assigned to the fifth row of the store, and is connected to the negative voltage −US. Thus, the binary value 1, which corresponds to a tabulation mark, is written into the storage element located in the first column and the fifth row of the store.

If an existing tabulation mark is to be cancelled at such position, an erasing key LO is actuated, with the resulting signal releasing an AND gate U7 and triggering the monoflop M over the OR gate D1 into its astable state. The pulse IM at the output of the monoflop M is conducted to the AND gate U1 in the same way as in the case of the setting of the tabulation mark. Simultaneously, the pulse is conducted over the AND gate U7 and the AND gate U5 to that of the transistors TS which is assigned to the fifth row of the store and is connected to the positive voltage +US. Consequently, the binary value 0 is written into the storage element located in the first column and the fifth row of the store SP, or an existing tabulation mark is thereby cancelled or erased.

As a result of subsequent "interspace" signals, the carriage of the teleprinter is brought to a different position, and in the same way the tabulation marks are set or erased with the aid of the setting key SET or the erasing or cancelling key LO. Where vertical tabulation is involved, the transmitter control unit SST will supply "line feed" signals instead of "interspace" signals and the "linefeed" signals are conducted in like manner to the receiver control unit EST. The tabulation marks are read out and set or cancelled in the same way as described with respect to horizontal tabulation.

Having thus described my invention it will be obvious that although various minor modifications might be suggested by those versed in the art, it should be understood that I wish to embody within the scope of the patent granted hereon all such modifications as reasonably, and properly come within the scope of my contribution to the art.

I claim as my invention:

1. In a tabulator device for typewriters, particularly for teleprinters or data-printers, in which tabulation marks are set, cancelled and recalled, the combination of a semiconductor store having electronically operable storage elements, arranged in the form of a matrix having a plurality of rows and columns, in which the tabulation marks are stored, said storage elements being operative to retain their respective contents independently of the operating voltage thereto, register means which operatively contains the addresses of the particular actuated storage elements, means, including a write-in control unit, operatively connected with said store and register means for selectively writing the tabulation marks into the store or cancelling the same therefrom, said register means comprising a pair of registers, one for row designation and the other for column designation, cooperable to supply the addresses to said store for designating the respective storage elements thereof, and means, including a read-out control unit, operatively connected with said store and register means for reading tabulation marks out of said store.

2. A tabulator device according to claim 1, wherein said registers are constructed as shift registers with feedback, means for shifting the contents of the row-designating register by single position increments following each row advance, and means for shifting the column-designating register by one position following each complete cycle of the row-designating register.

* * * * *